United States Patent [19]

Artz et al.

[11] Patent Number: 4,601,324

[45] Date of Patent: Jul. 22, 1986

[54] BELT SUPPORT FOR A TWIN-BELT CONTINUOUS CASTING MOLD

[75] Inventors: Gerd Artz, Ratingen; Gerhard Beckmann; Dieter Figge, both of Essen; Clemens Philipp, Meerbusch, all of Fed. Rep. of Germany

[73] Assignee: Fried. Krupp Gesellschaft mit beschränkter Haftung, Essen, Fed. Rep. of Germany

[21] Appl. No.: 759,163

[22] Filed: Jul. 26, 1985

[30] Foreign Application Priority Data

Aug. 25, 1984 [DE] Fed. Rep. of Germany ..... 3431316

[51] Int. Cl.[4] ..... B22D 11/06

[52] U.S. Cl. ..... 164/432; 164/431; 164/481

[58] Field of Search ..... 164/429, 430, 431, 432, 164/479, 481

[56] References Cited

U.S. PATENT DOCUMENTS 3,937,274 2/1976 Dompas .

*Primary Examiner*—Nicholas P. Godici

*Assistant Examiner*—Richard K. Seidel

*Attorney, Agent, or Firm*—Spencer & Frank

[57] ABSTRACT

A twin-belt continuous casting apparatus has a central support assembly (formed of rollers) in alignment with the mold chamber and arranged for backing up a respective casting belt at a plurality of locations; and lateral support assemblies in alignment with a respective side dam of the apparatus for backing up a respective casting belt against the side dams. Each lateral support assembly comprises a plurality of serially-arranged rolling bodies and a guiding arrangement for guiding each rolling body for a rolling advancement in the casting direction through a length portion while contacting a respective casting belt and for returning each rolling body from a downstream end of the length portion to an upstream end thereof while being out of contact with and oriented away from the casting belt. The length portion extends substantially from the inlet of the mold chamber and has a length which is, at the most, one fourth of the length of the mold chamber. During the casting operation there is, at any time, a plurality of rolling bodies in contact with a respective casting belt along the casting direction.

13 Claims, 9 Drawing Figures

BELT SUPPORT FOR A TWIN-BELT CONTINUOUS CASTING MOLD

BACKGROUND OF THE INVENTION

This invention relates to a back-up arrangement associated with the casting belts of a twin-belt continuous casting mold which is particularly adapted for making continuous bars of substantial cross-sectional width. The mold chamber is laterally bounded by side dams formed of side dam blocks articulated to one another and adjoining the casting belts which bound the mold chamber at the top and at the bottom. The casting apparatus has upper and lower end drums which are arranged at the inlet and, respectively, at the outlet of the mold and about which the respective upper and lower casting belts are trained.

The back-up arrangement for the casting belts includes, between the end drums, serially arranged, rotatable central belt supporting components which are in engagement with the casting belt and are in alignment with the mold chamber. The back-up arrangement further has lateral belt supporting assemblies which form stationary belt supporting zones parallel to the length of the mold chamber and which are in contact with the associated casting belt and are in alignment with the side dams.

In the casting of continuous bars which, viewed in cross section, have a relatively large width with respect to the height, and/or in the continuous casting under pressure, risks are high that molten metal penetrates into the zone between the casting belts and the side dam blocks and, as a result, as the mold walls move in the casting direction, fin-like growths may form, necessitating an interruption of the casting process.

U.S. Pat. No. 3,937,274 discloses a casting belt back-up assembly in which, for supporting the casting belts, in the zone of the side dams stationary sliding guides are provided which bridge the intermediate space between the frontal (upstream) and the rear (downstream) end drums. Between the sliding guides, transversely to the length dimension of the casting chamber, support rollers are provided which are spaced at relatively large distances from one another and whose narrow support shoulders engage the adjacent casting belt.

It is a disadvantage of the above-outlined prior art construction that the sliding faces—due to their unchanging position relative to the mold chamber—are heated to very high temperatures during the casting process. In the absence of complex measures for cooling and lubricating the sliding guides, the risk of damages to the twin-belt continuous casting mold—particularly caused by wear of the engaging sliding surfaces—cannot be excluded.

SUMMARY OF THE INVENTION

It is an object of the invention to provide an improved casting belt supporting (back-up) arrangement of the above-outlined type which ensures a superior support of the casting belts in the longitudinal direction and over the entire width of the mold chamber without needing a cooling of the twin-belt continuous casting mold in the zones of support.

It is a further object of the invention to provide that the components of the back-up arrangement, particularly also in the zone of the side dams are such that their locations of contact with the casting belts continuously change and are therefore not heated to excessively high temperatures.

It is still another object of the invention to provide a casting belt supporting arrangement which permits the manufacture of continuous bars having a cross section of significant width (above 250 mm and up to approximately 1200 mm), even if the molten metal entering the mold chamber is under pressure.

These objects and others to become apparent as the specification progresses, are accomplished by the invention, according to which, briefly stated, the lateral support assemblies are arranged in a frontal (upstream) zone of the twin-belt continuous casting mold, as viewed in the direction of casting, along a length which constitutes, at the most, the first quarter of the length of the mold chamber. The lateral support assemblies comprise a plurality of individual supports formed of rolling bodies rotatably entrainable by and travelling with the casting belts. The rolling bodies are oriented towards the casting belts cyclically and are in engagement therewith only for a predetermined period. The belt-contacting elements of a central support assembly are formed of individual rollers.

Thus, it is an essential aspect of the invention to equip the lateral support assemblies with rolling bodies which constitute in the inlet zone of the mold chamber, along not more than one fourth of its starting length, support zones of sufficient length and which, for avoiding a continuous contact in the zone of high temperatures, are oriented towards the casting belts only for predetermined periods. The support zones are formed by providing that at any time a plurality of the rolling bodies is at least in a point contact or in a linear contact with the adjacent casting belt. In many instances, based on considerations of operational safety concerning the belt supporting arrangement, it is sufficient if the lateral support assemblies back up the respective casting belt along a length which corresponds to the first fifth of the length of the mold chamber.

According to a further feature of the invention the length of the lateral support assemblies is designed such that in the inlet zone with each casting belt there are associated only a total of two such assemblies. In such a case the support zones provided by each assembly extend over the length of the inlet zone. The lateral support assemblies are so arranged with respect to the upstream end drums that as the casting belts reach the mold chamber inlet, they are already held against the side dams by the assemblies.

The provision of individual rollers for the central back-up assembly has the advantage—particularly in the manufacture of continuous bars with substantial widths—that long support rollers (which sometimes have substantial diameters) may be dispensed with; that is, the bending of the associated carrier shafts may be controlled in a desired manner without the normally necessary spatial requirement. Further, the central back-up elements may be at reduced distances from one another, as compared to prior art structures, as viewed along the length of the mold chamber and thus are able to support the adjacent casting belts in a more uniform manner, particularly also in the vicinity of the casting belt-supporting end drums.

According to a further feature of the invention, the length of the support zone formed by the totality of the momentarily operative rolling bodies of the respective lateral support assemblies is a number of times greater than the diameter of the rolling bodies of the lateral support assemblies.

According to still another feature of the invention, the individual rollers of the central support assembly are staggered along the length of the mold chamber. In this manner, a sufficient number of individual rollers may be accommodated for the belt surface to be supported. Each roller is so constructed that at any time it engages the respective casting belt at multiple locations. For this purpose, each individual roller is provided with at least two roller rings axially spaced from one another.

According to still another feature of the invention, the longitudinally staggered central support rollers are held in groups by serially arranged, spaced carrier beams. Advantageously, the beams also carry the lateral support assemblies and accommodate a plurality of transverse rows of individual rollers in the zone of the mold chamber. Between adjacent carrier beams there are provided intermediate webs which, in a known manner, effect the admission and removal of a coolant in the respective casting belt zone and between the lateral support assemblies.

According to a further feature of the invention, the rolling bodies of each lateral support assembly are formed of rollers which are supported in a housing and which are movable on an endless guide track which has planar guide face portions. The rollers travel on the endless guide track as they are entrained, by rolling friction, by the respective casting belt. The housing, the endless guide track and the rollers are made of an anti-rust material.

Each housing may accommodate, in a side-by-side arrangement (that is, transversely to its length dimension), a plurality of rollers which form either a plurality of mutually independent endless "chains" or at least one multiple endless "chain". The axial length (measured transversely to the casting direction) of the travelling rollers or the total axial length of the side-by-side arranged travelling rollers (including spaces therebetween) in each housing is normally not less than the width of the associated side dam.

According to a further feature of the invention, cages for the travelling rollers are used whose guide track forms an oval oriented in a vertical plane. This arrangement ensures that each travelling roller contacts (supports) the belt only during one part of its travel and at any time a plurality of rollers simultaneously supplies a linear support.

According to another embodiment of the invention, the casting belts are backed up in the zone of the side dams such that the lateral support assemblies associated with each side dam form staggered and overlapping lines progressing in the length dimension of the mold chamber. By appropriately arranging the associated, consecutively situated lateral side assemblies, the respective casting belt is held without interruption against the side dams even if a plurality of relatively short lateral support assemblies is used over the entire length of the inlet zone of the mold chamber. Such an arrangement thus preconditions an overlap of the lateral support assemblies, wherein the support zones continue without interruption in the longitudinal direction.

In principle, the casting belt has to be backed up in the zone of the associated side dam only over such a partial length of the mold chamber which is needed by the bar to be cast for forming a casting shell of sufficient load-carrying property. As soon as such a casting shell is present, an additional support of the casting belts by lateral support assemblies may be dispensed with in the successive zones of the twin-belt continuous casting mold.

The side dam blocks made of a bronze alloy are heated during their travel in the course of the casting process, for example, from 120° C. at the mold chamber inlet to approximately 300° C. at the mold chamber outlet. Accordingly, the side dams undergo a heat-caused expansion which also causes a height change of a few tenths of a millimeter. Such a dimensional change has been taken into account heretofore—to be sure, only in an approximate manner—by the use of support rollers stepped in the casting direction in a multiple manner. Since in the twin-belt continuous casting mold under consideration the upper and lower frames which carry the co-travelling mold walls are supported immovably with respect to one another, the casting belts—because of the stepwise, approximate adaptation of the support roller surface—could lift off the side dams along one portion of the length of the mold chamber. Such an undesired occurrence would result in a premature interruption of the casting process.

In case the diameter of the work face of the supporting rollers is not stepped in the length direction, then—because of the immovability of the upper and lower frames—either an undesired deformation of the support rollers will result or the support rollers must have undesirably large diameters. In order to eliminate these disadvantages, according to a further feature of the invention the upper and lower frames are power-fittingly (i.e. by forming a non-positive connection) supported on one another by means of the upper and lower lateral support assemblies, the associated casting belts and the side dams. This arrangement has the advantage that even in case of pressure casting, the casting belts cannot be bent outwardly in the zone of the side dams since the casting belts—independently from any deformation of the side dams—are continuously loaded down by the weight of the upper frame (which may be assisted by an additional, adjustable weight).

According to a further feature of the invention, the upper frame is movably supported such that it can be adapted to the temperature-caused deformations of the side dams. For this purpose, the upper frame—contrary to the stationary lower frame—is held by two Cardan joints. Preferably, the upper frame is held by two pivotal arms which have a longitudinal pivot shaft oriented in the length dimension of the mold chamber and a horizontal, transverse pivot shaft which is oriented perpendicularly to the longitudinal pivot shaft. Each pivotal arm carries a compensating weight. The two pivotal arms provide for a sufficient mobility of the upper frame such that in the inlet zone the required seal between the casting belts and the side dams is ensured by the lateral support assemblies. The adjusting of the upper frame with respect to the lower frame may be simplified by providing that the upper frame is height adjustable in the vertical direction. The adjusting mechanism is preferably a hydraulic power cylinder unit.

According to a further feature of the invention, the upper and lower frames are suspended from a common stand. The lower frame, unilaterally mounted on the stand, has a releasable carrying unit constituted by a transversely displaceable sled at the side opposite the stand. The sled is provided with a plurality of carrier pins arranged in the length dimension of the lower frame on which the latter is supported in the working position. The use of a sled ensures that the lower frame which is loaded also by the upper frame, has a support of sufficient load carrying properties and, at the same time, the mold is accessible in the zone of the mold chamber to the required extent. The upper frame supported movably with respect to the adjacent supporting components is preferably provided with a weight compensating mechanism.

DESCRIPTION OF THE PREFERRED EMBODIMENTS

Figure 1:
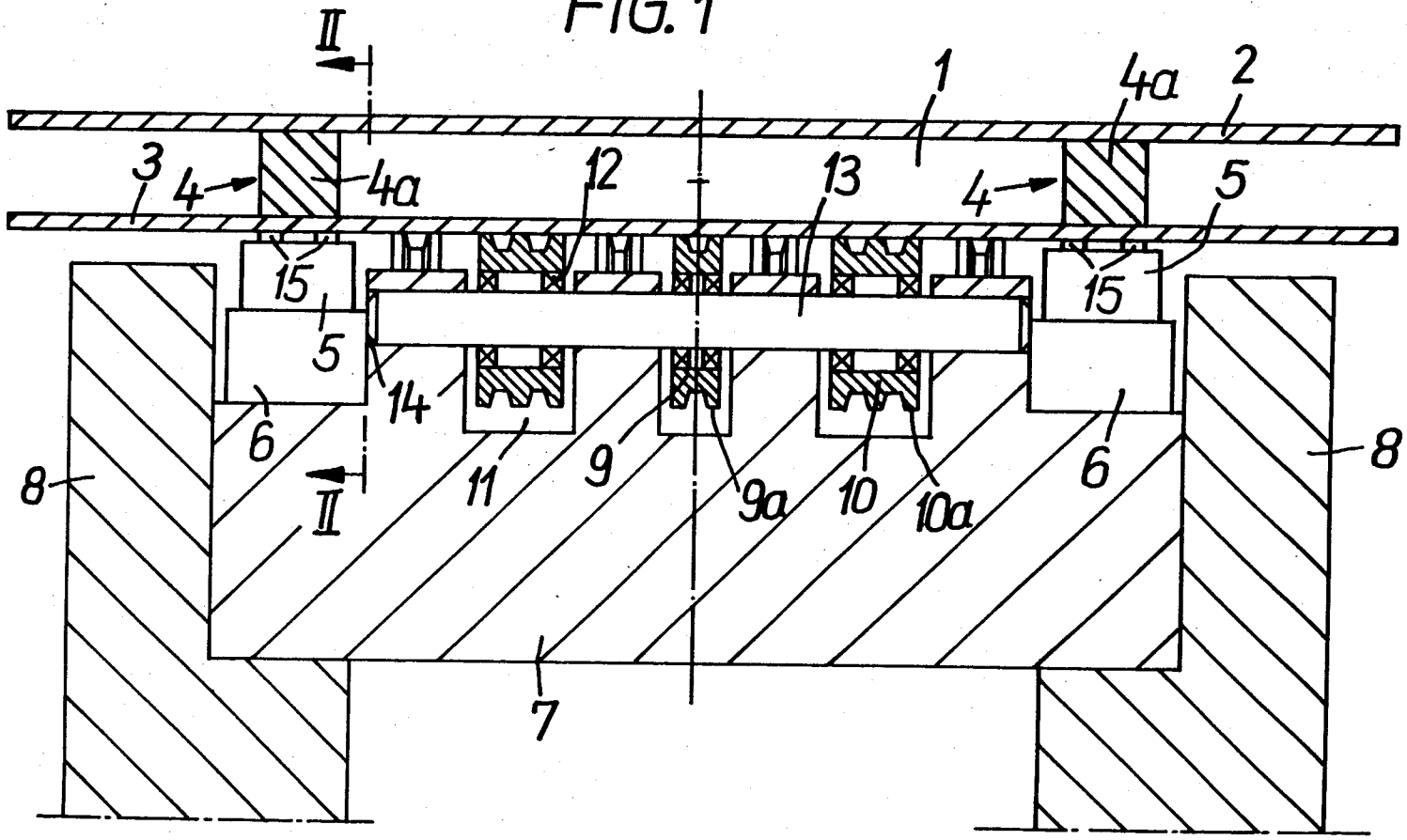
FIG. 1 is a schematic sectional front elevational view of a preferred embodiment of the invention.

Turning to FIG. 1, there is illustrated a preferred embodiment of the invention for use with a twin-belt continuous casting apparatus adapted to manufacture a continuous bar of a cross section having a width of approximately 1000 mm and a height of approximately 50 mm. The apparatus has a mold chamber 1 which is defined on the top and the bottom by a respective upper and lower casting belt 2 and 3 and on its sides by endless side dams 4 each formed of side dam blocks 4*a* articulated to one another. In the zone of the mold chamber 1 the side dams 4 extend between the upper casting belt 2 and the lower casting belt 3 as it may also be observed in FIG. 7*a*.

The casting belts 2 and 3 as well as the side dams 4 move as a unit perpendicularly to the plane of FIG. 1, away from the observer. Contrary to the casting belts 2 and 3 which are constituted by relatively thin steel bands, the side dams 4 which are made of a bronze alloy, are not cooled during the casting process.

The support (back-up) of the lower casting belt 3 is, similarly to the upper casting belt 2, effected in part by two lateral support assemblies 5 which are in alignment with the left and, respectively, right side dams 4 in the inlet zone of the mold chamber 1. By inlet zone there is meant that length portion of the mold chamber which is necessary for forming, for the cast bar, a casting shell of sufficient load carrying properties. Such a length portion is normally one-fifth, but may be as much as one-fourth of the length of the mold chamber 1. The two lateral support assemblies 5, which are mounted on base blocks 6, supported, in turn, on transverse carrier beams 7 of the lower casting frame 8 of the twin-belt continuous casting apparatus, prevent the appearance of a clearance between the side dams 4 and the associated casting belt 2 or 3 even in case of high pressures prevailing in the mold chamber 1. The lateral support assemblies 5 each comprise a plurality of individual supports arranged consecutively in the longitudinal direction of the mold chamber. The individual supports (which will be described in greater detail later) are, in cyclically repetitive time periods, oriented towards the respective casting belt only temporarily and thus will not be heated to excessively high temperatures.

Figure 3:
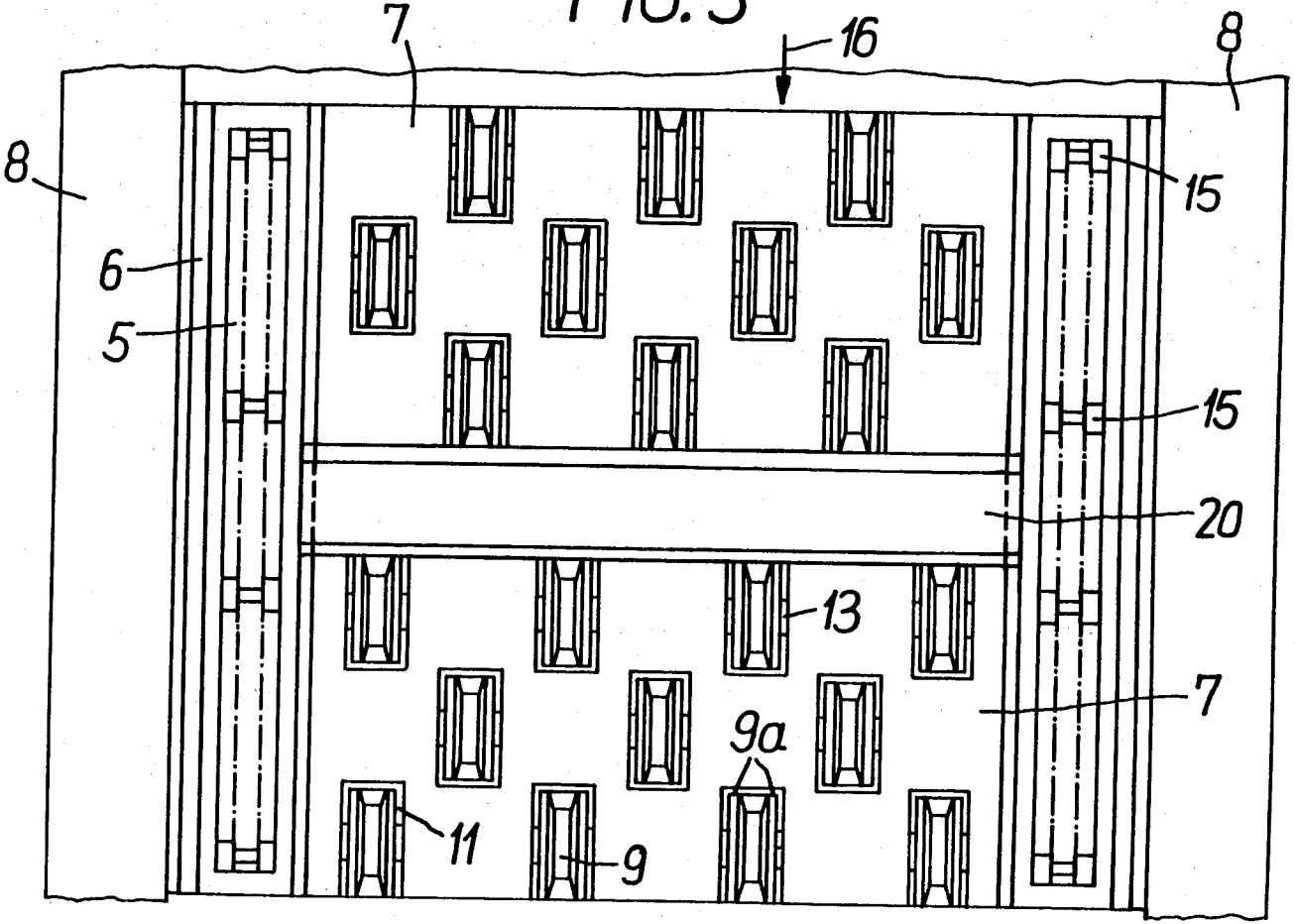
FIG. 3 is a schematic top plan view of the preferred embodiment, including a slight modification.

In the zone between the lateral support assemblies 5, that is, underneath (or, respectively, above) the mold chamber 1, there is arranged a central support assembly formed of individual rollers 9 and 10 each having two or three spaced roller rings 9*a* or, respectively, 10*a* for backing up the respective casting belt 2 or 3. FIG. 1 illustrates the back-up of the lower casting belt 3 by the central belt supporting assembly. The rollers 9 and 10 are accommodated in respective recesses 11 provided in the carrier beams 7. Each carrier beam 7 has, as seen in FIG. 3, three transverse rows of rollers, consisting alternatingly of three or four rollers 9 (as shown in FIG. 3) or 9 and 10 (as shown in FIG. 1). Rollers forming one row are staggered relative to the rollers of a consecutive row.

The individual rollers of each transverse row are carried, with the intermediary of a roller bearing 12, on a common roller shaft 13 which, externally of the recesses 14 is held at opposite ends in respective bores 14 of the associated carrier beam 7 between the support blocks 6.

Figure 2:
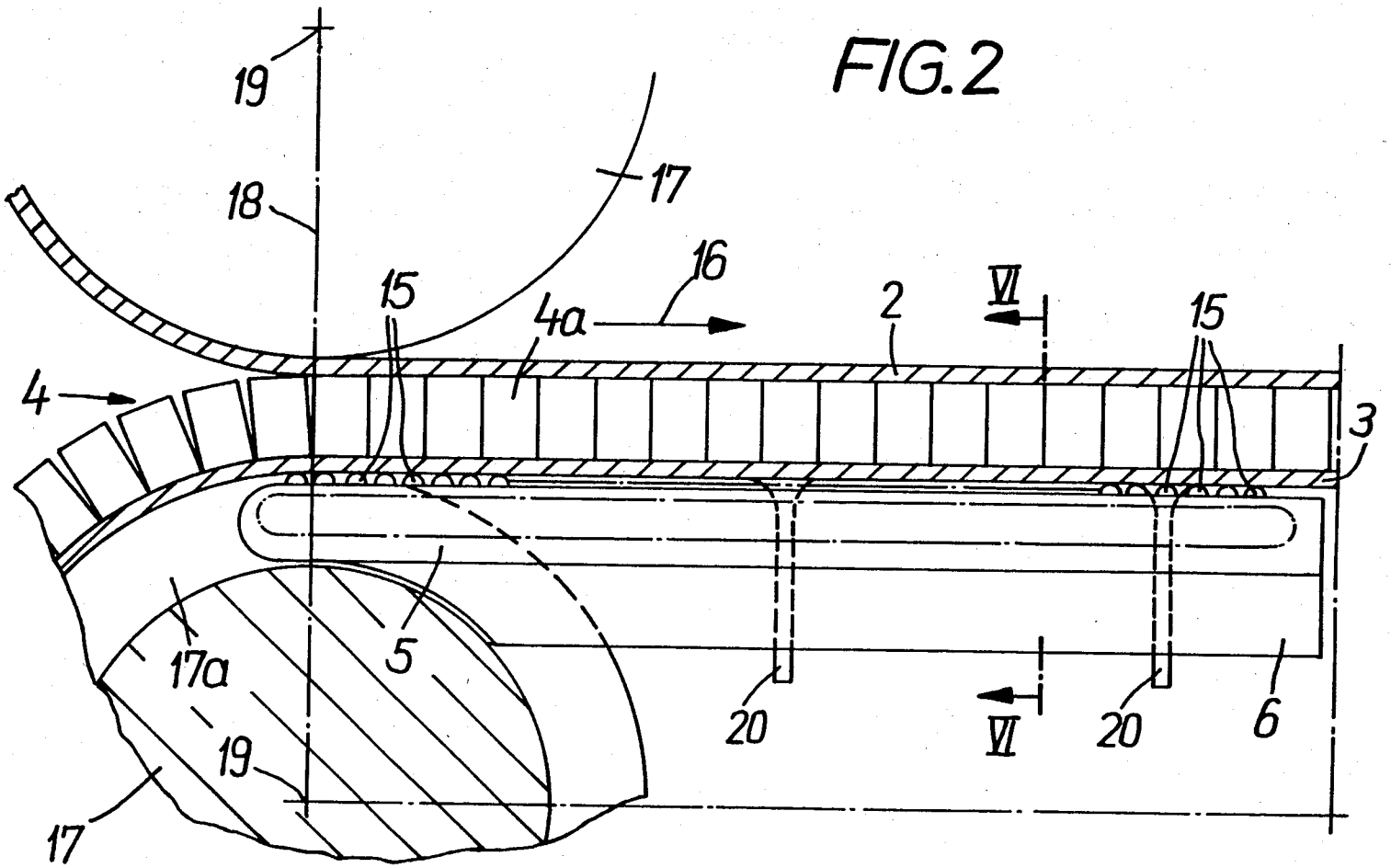
FIG. 2 is a schematic sectional view taken along line II—II of FIG. 1.

The embodiment illustrated in FIGS. 1, 2 and 3 may be modified in that each individual roller 9 or 10 may have its own roller shaft or, in case of transverse rows with four individual rollers, a two-part roller shaft may be provided.

The described two lateral support assemblies 5 prevent the lower casting belt 3 from lifting off the side dams 4. Each lateral support assembly 5 is formed of a plurality of individual supports constituted by travelling rollers 15 which are, only along one part of their travel, guided linearly, during which time they are in a supporting contact with the respective casting belt. It is of importance to so design the lateral support assemblies 5 that the individual supports thereof, while forming a support zone of required length parallel to the length dimension of the mold chamber 1, are only periodically in engagement with the respective casting belt. In the illustrated embodiment each lateral support assembly 5 extends, against the casting direction indicated by the arrow 16 to such an extent into a circumferential, groove-like recess 17*a* of the end drum 17 that the beginning portion of each lateral support assembly 5 is situated upstream of the mold chamber entrance. The location of the mold chamber entrance is indicated in FIG. 2 by the line 18 which connects the two axes 19 of the upper and lower upstream end drums 17. The length of each lateral support assembly 5 is so designed that the associated casting belt (thus, the lower casting belt 3 in FIG. 2) obtains the required support by the effect of the momentarily operative travelling rollers 15 over the entire length of the inlet zone of the mold chamber 1.

Each support block 6 is so designed in the zone of the end drums 17 that the lateral support assembly 5 which is rounded at its frontal zone may assume its above-noted position with respect to the mold chamber inlet indicated at 18.

The space between consecutive transverse carrier beams 7 in the length direction of the mold chamber 1 and underneath the lower casting belt 3 as well as above the upper casting belt 2 is divided by intermediate webs 20 into cooling sections in the zone of which the casting belts are, in a manner known by itself, exposed directly to a coolant between the cooperating lateral support assemblies 5.

Reverting once more to FIG. 3, the embodiment shown therein has, in the casting direction indicated by the arrow 16, two carrier beams 7 separated from one another by an intermediate web 20. Each beam 7 carries, in three transverse rows, ten or eleven rollers 9 in the zone between the two lateral support assemblies 5. Each transverse row is alternately provided with three or four individual rollers 9. By virtue of this arrangement the central support of the respective casting belt (thus, for example, the lower casting belt 3 shown in FIG. 1) is formed by the individual rollers 9 and continuously changes during the travel of the casting belt in the casting direction. It is to be taken into consideration in this connection that the contact line, too, formed with the respective casting belt follows the rotary motion of the individual rollers. The non-illustrated casting belt is supported also in the zone of the lateral support assemblies 5 in the longitudinal direction of the mold chamber 1 and is supported in the casting direction such that the longitudinal extent of the support is approximately equal to the length of support which is formed in the longitudinal direction by the totality of the individual rollers 9 of the two carrier beams 7. The intermediate web 20 which is arranged with a clearance from the adjacent carrier beams 7 is secured at its ends to the support blocks 6 which also carry the lateral support assemblies 5.

Figure 4:
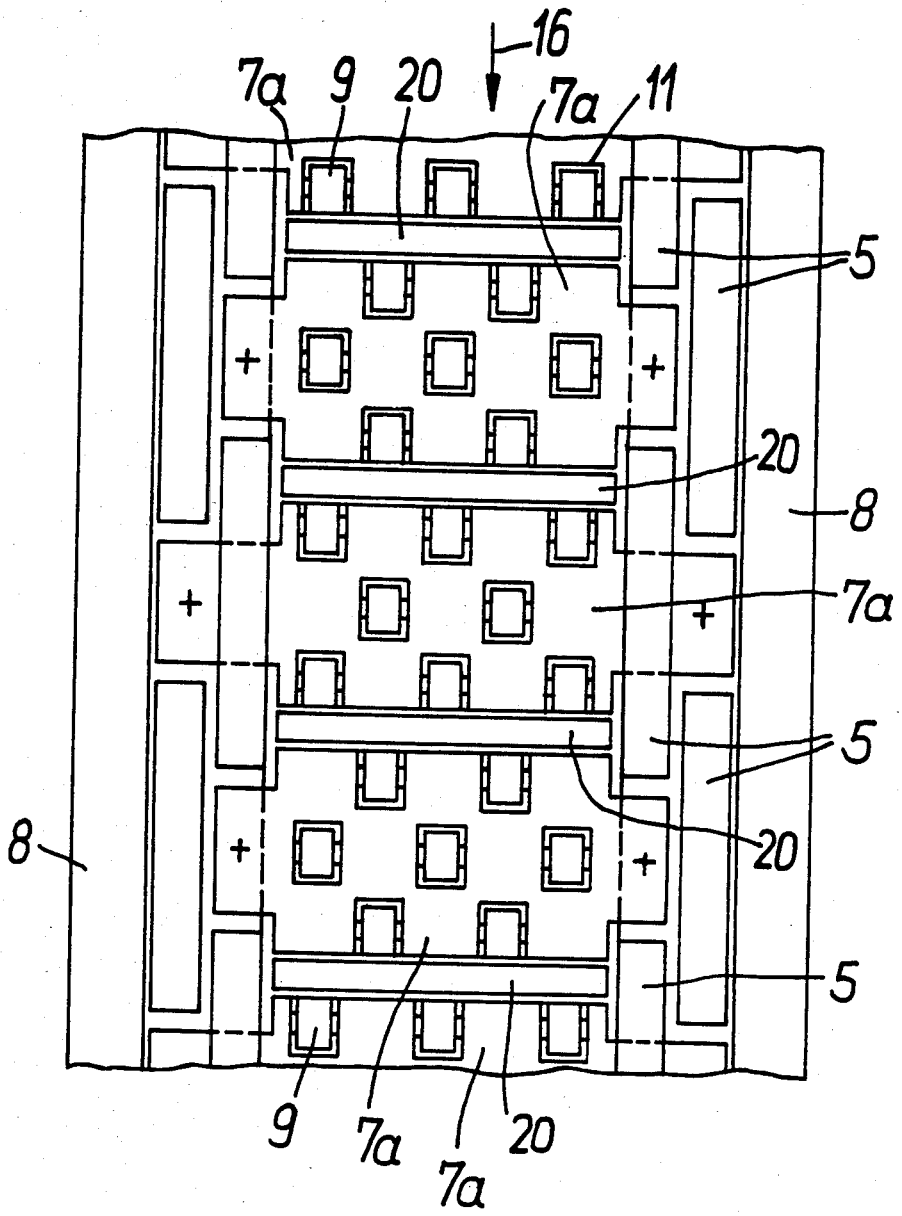
FIG. 4 is a schematic top plan view of another preferred embodiment of the invention.

A sufficient support of the casting belts in the zone of the lateral dams 4 may be realized with relatively short lateral support assemblies 5 by arranging the latter in a staggered, overlapping fashion as illustrated in FIG. 4. The lateral side assemblies are so arranged with respect to the associated side dams 4 that the longitudinal center line thereof (as viewed from the top) approximately coincides with the symmetry axis of the staggered lateral support assemblies as viewed as a whole. The inside lateral support assemblies 5 thus also contribute to the support of the respective casting belt in the zone of the mold chamber.

By virtue of the staggered arrangement of the lateral support assemblies 5 the carrier beams 7*a* which succeed one another in the casting direction are smaller in the transverse direction than the carrier beams 7 and have each three consecutive transverse rows formed alternatingly of two or three individual rollers 9.

The mutual overlap of the staggered lateral support assemblies 5 is so selected that the associated rollers form an uninterrupted support zone which has the required length corresponding approximately to the inlet zone of the mold chamber 1.

Figure 5A:
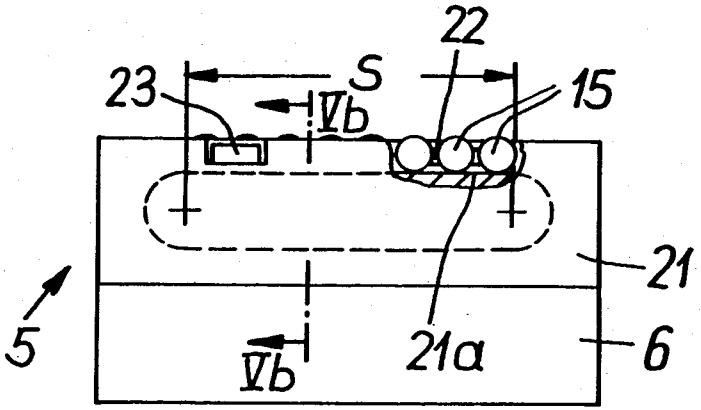
FIG. 5*a* is a schematic, partially sectional side elevational view of a component forming part of either preferred embodiment.
Figure 5B:
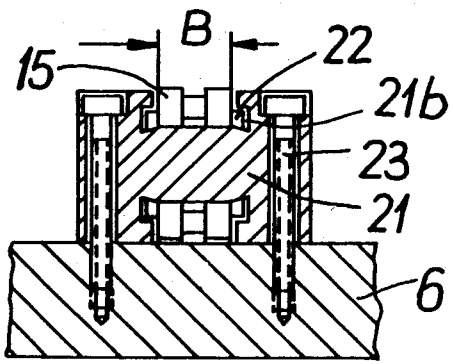
FIG. 5*b* is a sectional view taken along line Vb—Vb of FIG. 5*a*.

Also referring now to FIGS. 5*a* and 5*b*, each lateral support assembly 5 includes a housing 21 having an oval endless guide track 21*a* on which a relatively large number of travelling rollers 15 may circulate in synchronism with the casting belt to be supported. The travelling motion of the rollers 15 is imparted by the respective casting belt by rolling friction as it contacts the rollers 15. The rollers 15 are held in a known manner in a cage 22 which is movably supported in guide slots 21*b* of the housing 21 and which, as particularly well seen in FIG. 5*b*, prevents the orbiting rollers 15 from falling out of the housing 21.

In the zone of the upper linear guide surface of the guide track 21*a* the rollers 15 slightly project beyond the housing 21 and form there a support zone having a length S which is several times greater than the diameter of the rollers 15. Thus, the casting belt engaging the outer deflecting rollers has, in the zone of the support range S, a stationary back-up which is composed of a plurality of individual rollers 15 and which changes in cyclically repetitive time periods in that the respective rollers 15 temporarily leave, during their travel in an oval path, the upper, linear guide surface of the guide track 21*a*. Instead of the cage 22 there may be provided a holder rail which prevents the rollers 15 from falling out of the housing 21.

Figure 6:
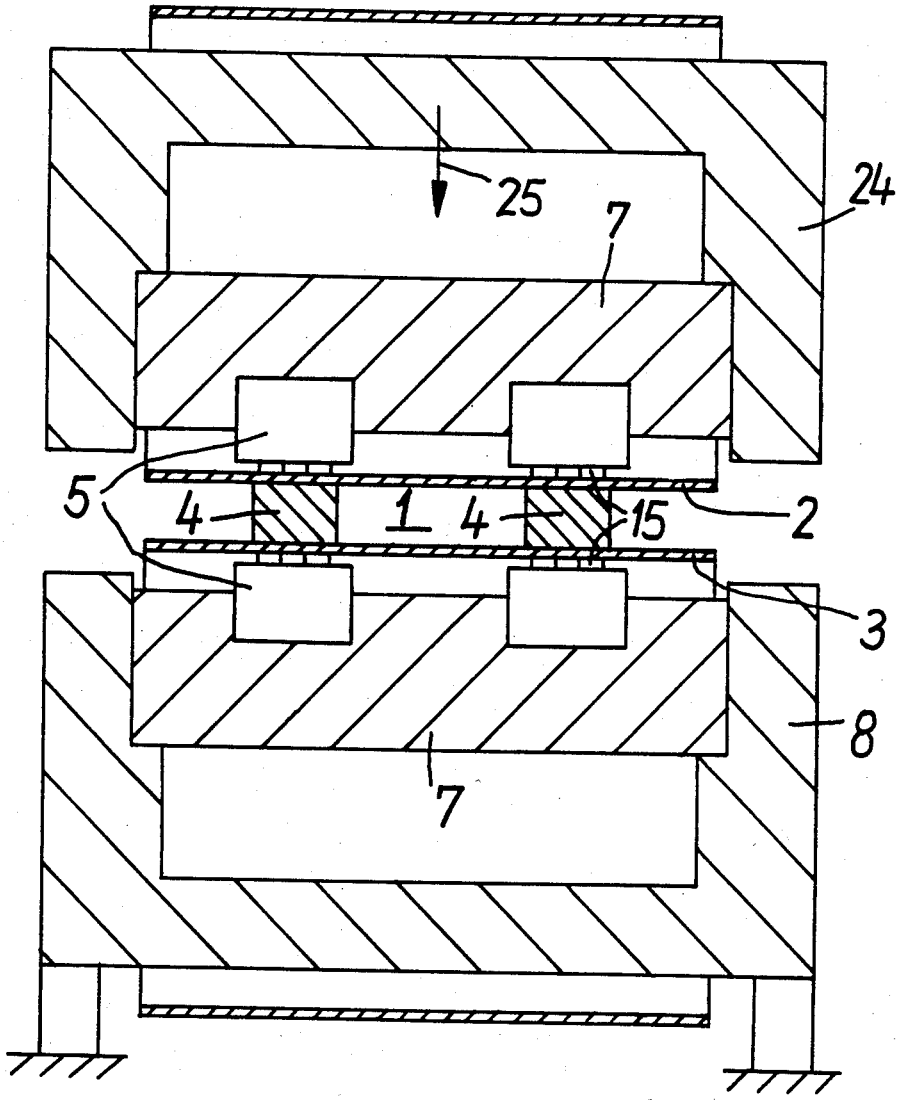
FIG. 6 is a schematic sectional view taken along line VI—VI of FIG. 2.

Each housing 21 which, similarly to the associated components, is made of an anti-rust material is secured to the respective support block 6 by means of Allen screws 23. The support width B formed by the travelling rollers 15 transversely to the length dimension of the housing 21 is at the most equal to, but preferably shorter than the width of the side dam 4, as seen in FIG. 6.

According to the embodiment illustrated in FIG. 2, the housing and the associated guide track 21*a* of the lateral support assemblies 5 are of such a length that the support zone formed by the totality of the momentarily operative travelling rollers 15 corresponds at least to the length of the inlet zone of the mold chamber 1.

According to prior art constructions, the upper and lower apparatus frames are rigidly supported by spacer bolts in such a manner that between the support rollers and the adjacent casting belts a clearance is provided which has a magnitude of several tenths of a millimeter. In contradistinction, according to the invention, as shown in the embodiment illustrated in FIG. 6, the upper frame 24 and the lower frame 8 are supported movable with respect to one another. The upper frame 24 power-fittingly lies on the lower frame 8 by means of its lateral support assemblies 5, the upper casting belt 2, the side dams 4, the lower casting belt 3 and the lateral support assemblies 5 associated with the lower frame 8.

By virtue of the power-fitting support of the upper frame 24 on the side dams 4, no clearance can appear between the latter and the casting belts 2 and 3 (in contradistinction to the prior art constructions), even if the molten metal flows into the mold chamber 1 under pressure. The temperature-caused dimensional changes of the lateral dams 4 have no disadvantageous effect, because the upper frame 24 can be self-adjusting with the associated lateral support assemblies 5 and the central supporting assembly including the support rollers 9 and 10. The force derived from the upper frame 24 in the direction of the lower frame 8 is indicated by an arrow 25.

Figure 7A:
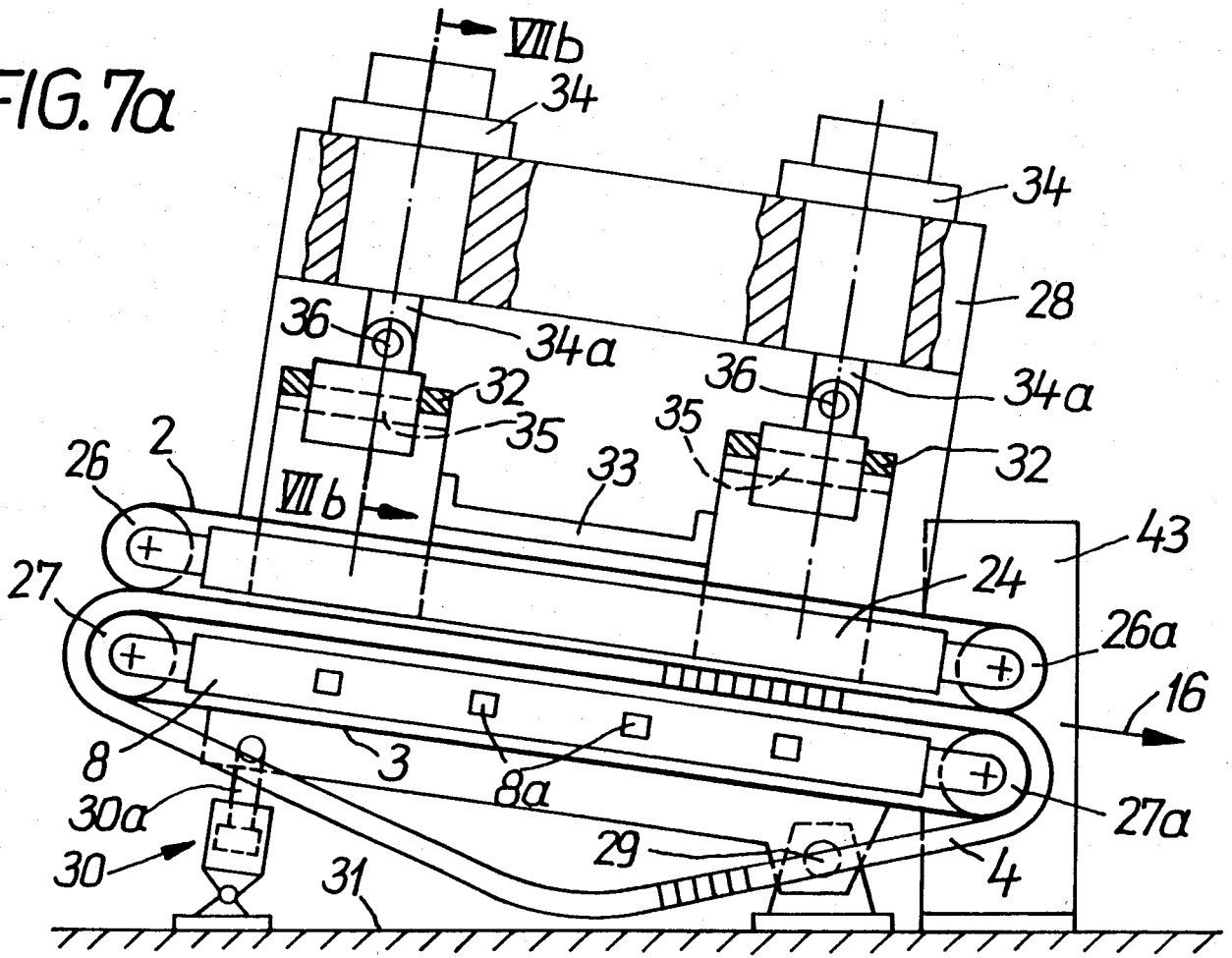
FIG. 7*a* is a schematic, partially sectional side elevational view, including further components of the invention.
Figure 7B:
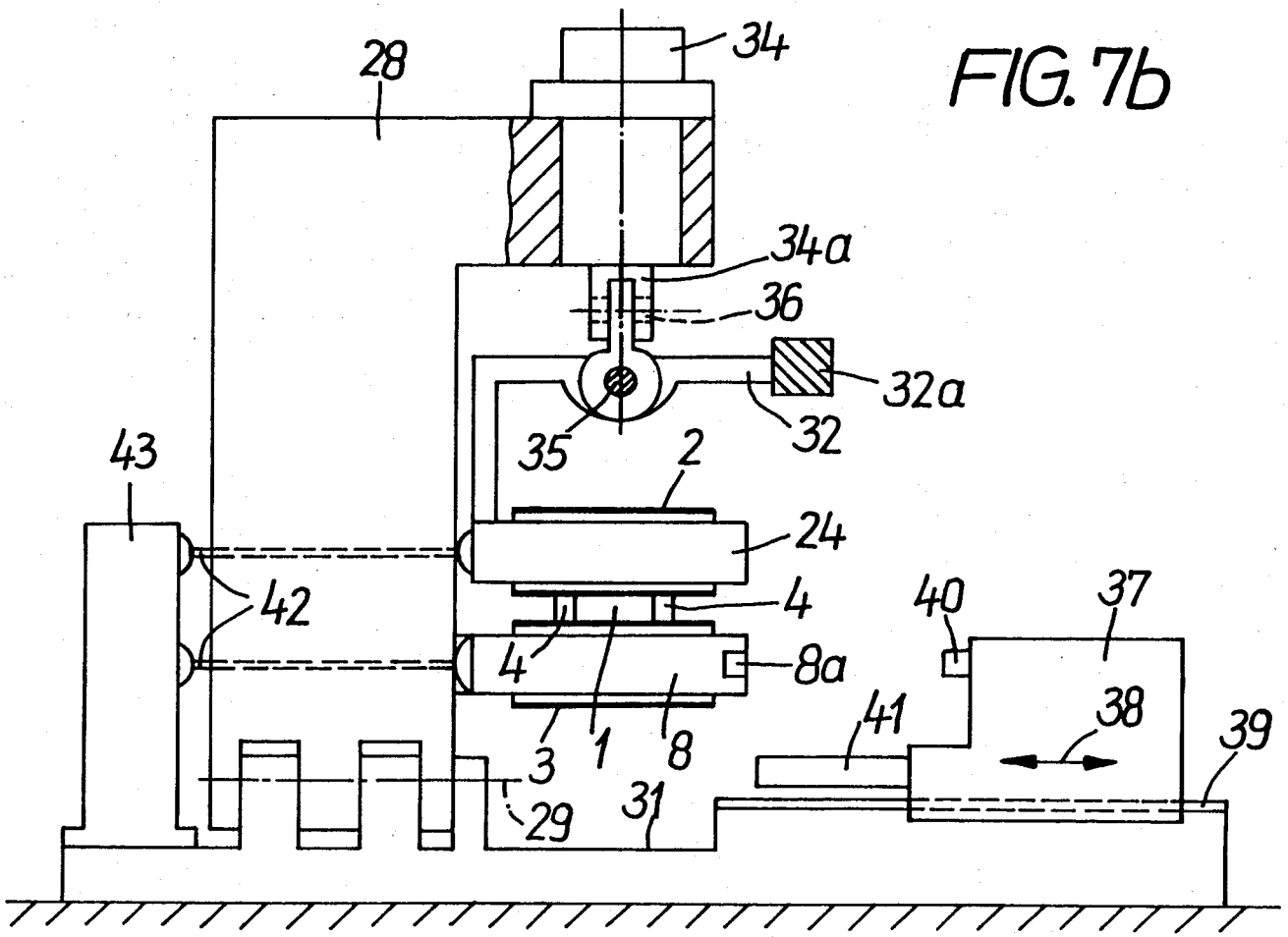
FIG. 7*b* is a sectional view taken along line VIIb—VIIb of FIG. 7*a*.

Turning now to FIGS. 7*a* and 7*b*, the upper frame 24 which supports the upper casting belt 2 by means of an upstream and a downstream end drum 26, 26*a* and the lower frame 8 which is provided with two end drums 27 and 27*a*, respectively, for supporting the lower casting belt 3 are supported on a stand 28 which has an angled cross-sectional configuration. The stand 28, in turn, is rotatably supported about a horizontal, stationary pivotal shaft 29 and has underneath the inlet zone of the mold chamber 1 a drive which is constituted by a hydraulic power cylinder 30 including an articulated piston 30*a* and which pivots the lower apparatus frame 8 about the shaft 29. In the casting position the stand 28 assumes an orientation in which the mold chamber 1 defines an angle of, for example, less than 10° with the horizontal (that is, with the floor 31). Both endless side dams 4 are supported on the end drums 27 and 27*a* of the lower frame 8.

While the lower frame 8 is, on its side oriented towards the stand 28, fixedly connected therewith, the upper frame 24 is held by two pivotal arms 32 which are secured to one another by means of a longitudinal carrier 33 and which are height-adjustable in a vertical direction by means of hydraulic cylinders 34 provided in the head of the stand 28. The Cardan joint-like connection between each setting piston 34*a* of the respective hydraulic power cylinder 34 and the associated pivotal arm 32 has a longitudinal pivot shaft 35 extending parallel to the length dimension of the mold chamber 1 and a horizontal, transverse pivot shaft 36 oriented perpendicularly to the longitudinal axis 35. On the side oriented away from the stand 28 the pivotal arms 32 are each provided with a compensating weight 32*a* shown only in FIG. 7*b*.

Since the upper frame 24 is adjustably supported on the lower frame 8 with the intermediary of parts 2, 4 and 3, the lower frame 8 has to be equipped with a supporting unit having sufficient load carrying capabilities. For this purpose and also for reasons of easy accessibility to the zone of the mold walls 2, 3 and 4, the supporting unit comprises a sled 37 which is displaceable on a guide track 39 (supported on the floor 31) in the direction of the double-headed arrow 38, transversely to the casting direction. The sled 37 has, on its side oriented towards the stand 28, a plurality of carrier pins 40 arranged serially in the casting direction and further has, at a height level underneath the lower frame 8, a freely projecting working platform 41 from which the zones of the casting belts 2 and 3, the side dams 4, as well as the lower and upper frames 8 and 24 may be serviced in the position of rest shown in FIG. 7*b*. By displacing the sled 37 towards the left as viewed in FIG. 7*b*, the carrier pins 40 engage into corresponding recesses 8*a* provided in the lower frame 8 (FIG. 7*a*) and thus provide the necessary lateral support for the lower frame 8. The end drums 26*a* and 27*a* are connected by means of articulated shafts (shown only symbolically) with a drive unit 43 which is supported on the floor 31 at that side of the stand 28 which is oriented towards the sled 37.

By virtue of the height adjustable and Cardan-type suspension of the pivotal arms 32, the upper frame 24 is supported—at least under the effect of its own weight (and, if necessary, by means of a settable additional weight)—in such a manner by the lower frame 8 with the intermediary of the side dams 4 that during the casting operation a satisfactory seal is continuously ensured between the casting belts 2 and 3 on the one hand and the side dams 4, on the other hand.

Excessive, impermissible excursions of the casting belts 2 and 3 are prevented by ensuring that the upper frame 24 and the lower frame 8 are provided with lateral support assemblies as described in detail above which back up the respective casting belt in the inlet zone of the mold chamber from above or from below, as the case may be, and thus hold them in position against the side dams 4.

The embodiment illustrated in FIGS. 7*a* and 7*b* is so designed that the lower frame 8 can be locked with the associated carrier pins 40 of the sled 37 solely in a predetermined oblique position. The illustrated twin-belt continuous casting mold, together with the stand 28, may therefore be arranged immovably, that is, the pivotal drive 30 and the pivotal shaft 29 may be dispensed with.

To provide, however, that the twin-belt continuous casting mold can be operated at different inclinations to the horizontal, the sled 37 is provided with height adjustable carrier pins 40. These may be held on a movable carrier bar which is supported on the sled 37 in an angularly adjustable manner. The position of the carrier pins 40 may thus be changed according to a corresponding displacement of the carrier bar to adapt to the requirements the inclination of the lower frame 8 and the mold chamber 1.

It will be understood that the above description of the present invention is susceptible to various modifications, changes and adaptations, and the same are intended to be comprehended within the meaning and range of equivalents of the appended claims.

What is claimed is:

1. In a twin-belt continuous casting apparatus including a mold chamber defined by upper and lower travelling casting belts and travelling side dams bounded by the casting belts; said chamber having an inlet and an outlet downstream of said inlet as viewed in a travelling direction of the casting belts and the side dams; said travelling direction defining a casting direction of said apparatus and the distance between said inlet and said outlet defining the length of said mold chamber; end drums arranged at said inlet and said outlet; said casting belts being trained about respective said end drums; a central support assembly extending along a first length portion of said mold chamber between said inlet and said outlet; said central support assembly being in alignment with said mold chamber and being arranged for backing up a respective said casting belt at a plurality of locations; and lateral support assemblies extending along a second length portion of said mold chamber; said lateral support assemblies being in alignment with a respective said side dam and being arranged for backing up a respective said casting belt along said second length portion against the side dams; the improvement wherein each lateral support assembly comprises a plurality of serially-arranged rolling bodies having rotary axes extending generally parallel to an adjacent said casting belt and perpendicularly to said casting direction; guiding means for guiding each rolling body for a rolling advancement in said casting direction through said second length portion while contacting a respective said casting belt and for returning each rolling body from a downstream end of said second length portion to an upstream end thereof while being out of contact with and oriented away from the casting belt; said second length portion extending substantially from said inlet of said mold chamber and having a length which is, at the most, one fourth of the length of said mold chamber; during casting operation there being at any time a plurality of said rolling bodies in contact with a respective said casting belt along said second length portion at a plurality of locations spaced from one another parallel to said casting direction; and further wherein said central support assembly comprises a plurality of rotatably supported rollers arranged in series along said first length portion.

2. An apparatus as defined in claim 1, wherein each said rolling body has a diameter and wherein the length of said second length portion is several times greater than said diameter.

3. An apparatus as defined in claim 1, wherein consecutive rollers of said central support assembly are laterally staggered as viewed in said casting direction.

4. An apparatus as defined in claim 1, further comprising a machine frame; a plurality of spaced carrier beams supported on the machine frame and arranged serially in said casting direction; each said carrier beam forming part of said central support assembly and supporting a plurality of said rotatably supported rollers.

5. An apparatus as defined in claim 1, wherein with each side dam there is associated a plurality of said lateral guide assemblies arranged in a laterally staggered series extending parallel to said casting direction.

6. An apparatus as defined in claim 1, wherein said guiding means of each said lateral support assembly comprises a housing defining an endless guide track and means for retaining said rolling bodies on said guide track; said rolling bodies being constituted by rollers arranged for an endless rolling travel on said guide track; said guide track having a linear guide portion corresponding in length and in position to said second length portion.

7. An apparatus as defined in claim 6, wherein said guide track has a shape of an oval oriented vertically.

8. An apparatus as defined in claim 1, further comprising an upper machine frame and a lower machine frame for supporting the respective upper and lower casting belt, the side dams and the central and lateral support assemblies; said upper machine frame being supported on said lower frame with an interposition of the lateral support assemblies associated with said upper casting belt, said upper casting belt, said side dams, said lower casting belt and the lateral support assemblies associated with said lower casting belt.

9. An apparatus as defined in claim 8, further comprising means for adjusting the height of said upper frame in a vertical direction.

10. An apparatus as defined in claim 8, further comprising a machine stand and two Cardan joints suspending said upper frame from said machine stand.

11. An apparatus as defined in claim 10, further comprising a counterweight for balancing said upper frame on said Cardan joints.

12. An apparatus as defined in claim 10, wherein said lower frame has opposite first and second longitudinal sides; said lower frame being mounted on said stand along said first side; further comprising a releasable support unit including a support sled arranged for a horizontal movement towards or away from said second side of said lower frame; said support sled having a plurality of carrier members arranged serially generally parallel to a length dimension of said lower frame; said support sled having a position in which said carrier members of said support sled support said lower frame at said second side thereof.

13. An apparatus as defined in claim 12, further comprising a pivotal support mounting said stand for pivotal adjustment in a vertical plane for varying the angle formed between said travelling direction and the horizontal.

* * * * *